United States Patent [19]

Meskin et al.

[11] Patent Number: 4,726,718

[45] Date of Patent: Feb. 23, 1988

[54] MULTI-COMPONENT CUTTING ELEMENT USING TRIANGULAR, RECTANGULAR AND HIGHER ORDER POLYHEDRAL-SHAPED POLYCRYSTALLINE DIAMOND DISKS

[75] Inventors: Alexander K. Meskin, Salt Lake City; Leo Merrill, Orem; Clifford R. Pay, Woods Cross, all of Utah

[73] Assignee: Eastman Christensen Co., Salt Lake City, Utah

[21] Appl. No.: 797,445

[22] Filed: Nov. 13, 1985

Related U.S. Application Data

[63] Continuation of Ser. No. 593,102, Mar. 26, 1984, abandoned.

[51] Int. Cl.[4] ..... B23B 27/20

[52] U.S. Cl. ..... 408/145; 51/206 R; 175/329; 125/39

[58] Field of Search ..... 408/145, 144; 125/11 R, 125/39; 51/204, 206 R; 76/DIG. 11, DIG. 12, 101 R; 175/329, 330; 407/118, 119

[56] References Cited

U.S. PATENT DOCUMENTS

| | | | |
|---|---|---|---|
| 3,791,367 | 2/1974 | Cirell et al. | 125/39 X |
| 4,041,650 | 8/1977 | Sawluk | 51/206 R |
| 4,529,047 | 7/1985 | Meskin et al. | 175/329 |

FOREIGN PATENT DOCUMENTS

| | | | |
|---|---|---|---|
| 2921196 | 12/1980 | Fed. Rep. of Germany | 125/39 |
| 2115460 | 9/1983 | United Kingdom | 175/329 |

*Primary Examiner*—E. R. Kazenske
*Assistant Examiner*—William Fridie, Jr.
*Attorney, Agent, or Firm*—Beehler, Pavitt, Siegemund, Jagger, Martella & Dawes

[57] ABSTRACT

A diamond cutter for use in a drill bit having a geometric size and shape normally characterized by unleached diamond product, such as STRATAPAX diamond cutters, can be fabricated by assembling a plurality of prefabricated leached polycrystalline diamond (PCD) elements in an array in a cutting slug. A cutting slug is formed of matrix material which in one embodiment is impregnated with diamond grit. The cutting face of the cutting slug is characterized by exposing at least one surface of each of the PCD elements disposed therein. The diamonds may be set within the cutting slug either in a compact touching array or in a spaced-apart relationship. More than one type of array may also be employed within a single cutting slug. The PCD elements can assume a variety of polyhedral shapes such as triangular prismatic elements, rectangular elements, hexagonal elements and the like. The plurality of diamond elements and the cutting slug are fabricated using hot pressing or infiltration techniques.

5 Claims, 8 Drawing Figures

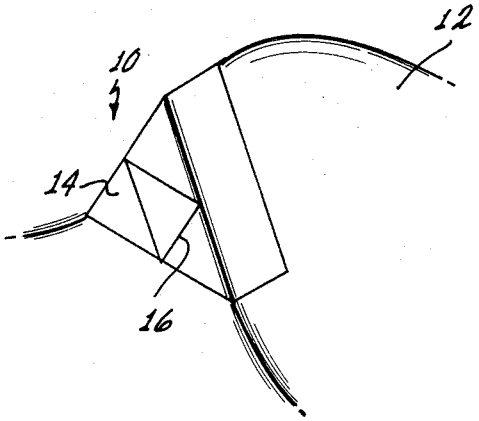
FIG. 1
FIG. 2
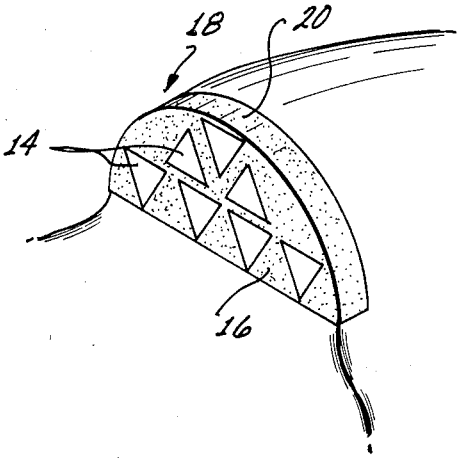
FIG. 3
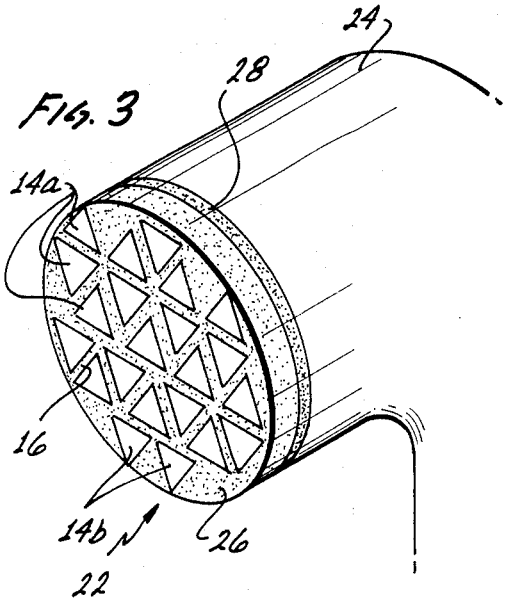
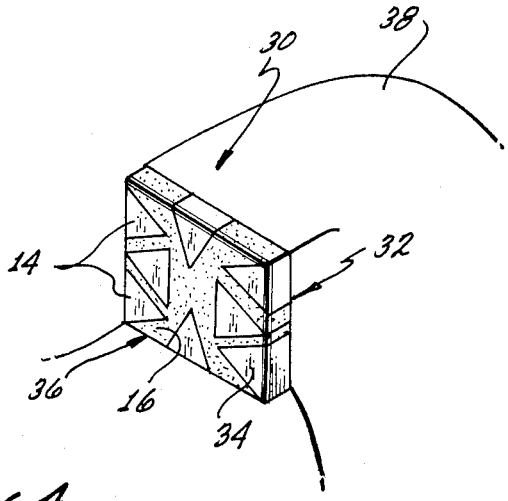
FIG. 4

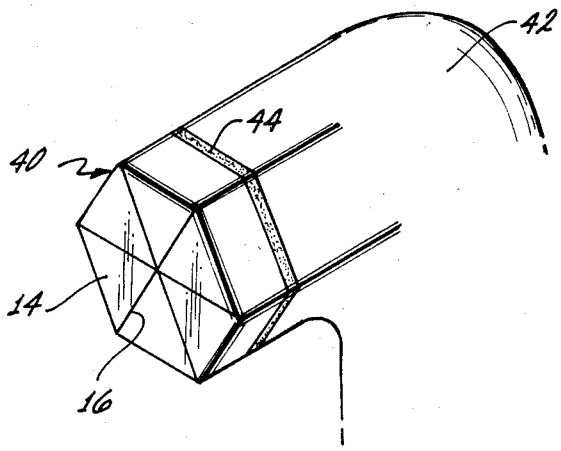
FIG. 5
FIG. 6
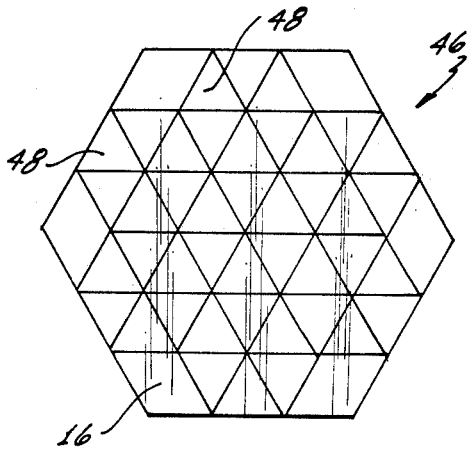
FIG. 7
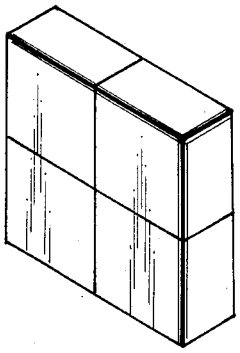
FIG. 8
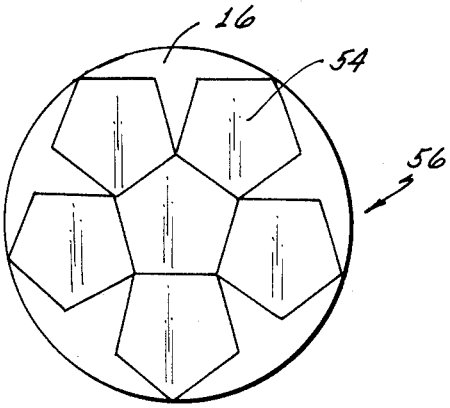

MULTI-COMPONENT CUTTING ELEMENT USING TRIANGULAR, RECTANGULAR AND HIGHER ORDER POLYHEDRAL-SHAPED POLYCRYSTALLINE DIAMOND DISKS

This is a continuation, of application Ser. No. 593,102 filed Mar. 26, 1984, abandoned.

BACKGROUND OF THE INVENTION

1. Field of the Invention

The present invention relates to the field of earth boring tools and in particular relates to diamond cutters used on rotating bits.

2. Description of the Prior Art

Rotating diamond drill bits were initially manufactured with natural diamonds of industrial quality. The diamonds were square, round or of irregular shape and fully embedded in a metallic bit body, which was generally fabricated by powder metallurgical techniques. Typically, the natural diamonds were of a small size ranging from various grades of grit to larger sizes where natural diamonds of 5 or 6 stones per carat were fully embedded in the metal matrix. Because of the small size of the natural diamonds, it was necessary to fully embed the diamonds within the matrix in order to retain them on the bit face under the tremendous pressures and forces to which a drill bit is subjected during rock drilling.

Later, the commercial production of synthetically produced diamond grit and polycrystalline stones became a reality. For example, synthetic diamond was sintered into larger disk shapes and were formed as metal compacts, typically forming an amalgam of polycrystalline sintered diamond and cobalt carbide. Such diamond tables are commercially manufactured by General Electric Company under the trademark STRATAPAX. The diamond tables are bonded, usually within a diamond press to a cobalt carbide slug and sold as an integral slug cutter. The slug cutters are then attached by the drill bit manufacturers to a tungsten carbide slug which is fixed within a drill bit body according to the design of the bit manufacturer.

However, such prior art polycrystalline diamond (PCD) compact cutting slugs are characterised by a low temperature stability. Therefore, their direct incorporation into an infiltrated matrix bit body is not practical or possible at this time.

In an attempt to manufacture diamond cutting elements of improved hardness, abrasion resistance and temperature stability, prior art diamond synthesizers have developed a polycrystalline sintered diamond element from which the metallic interstitial components, typically cobalt, carbide and the like, have been leached or otherwise removed. Such leached polycrystalline synthetic diamond is manufactured by the General Electric Company under the trademark GEOSET, for example 2102 GEOSETS, which are formed in the shape of an equilateral prismatic triangle 4 mm on a side and 2.6 mm deep (3 per carat), and as a 2103 GEOSET shaped in the form of an equilateral triangular prismatic element 6 mm on a side and 3.7 mm deep (1 per carat). However, due to present fabrication techniques, in order to leach the synthetic sintered PCD and achieve the improved temperature stability, it is necessary that these diamond elements be limited in size. Therefore, whereas the diamond compact slug cutters, STRATAPAX, may be formed in the shape of circular disks of ⅜" (9.5 mm) to ½" (12.7 mm) in diameter, the leached triangular prismatic diamonds, GEOSETS, have maximum dimensions of 4 mm to 6 mm. It is well established that the cutting rate of a diamond rotating bit is substantially improved by the size of the exposed diamond element available for useful cutting. Therefore, according to the prior art, the increased temperature stability of leached diamond products has been achieved only at the sacrifice of the size of the diamond elements and therefore the amount of diamond available in a bit design for useful cutting action.

What is needed then is a PCD cutter which is characterised by the temperature stability and characteristics of leached diamond products, and yet has the size available for useful cutting action which is characterised by the larger unleached diamond products.

BRIEF SUMMARY OF THE INVENTION

The invention is a diamond cutter for use in a drill bit. The diamond cutter comprises a plurality of thermally stable, prefabricated, synthetic polycrystalline diamond (PCD) elements. A cutting slug is provided and is characterized by a cutting face. The cutting slug is comprised of a metallic matrix material. The PCD elements are disposed in the cutting slug and retained therein by the matrix material. The matrix material also incorporates a dispersion of diamond grit, at least in that portion of the matrix material adjacent to the cutting face of the cutting slug. By reason of this combination of elements, an enlarged diamond cutter is provided for mounting in the drill bit.

More particularly, the invention is a diamond cutter for use in a rotating drill bit comprising a plurality of leached PCD triangular prismatic and prefabricated elements. A cutting slug is provided and is comprised of a metallic matrix material and characterized by a cutting face. The plurality of PCD elements are disposed in an array within the cutting slug. Each one of the PCD elements has at least one surface which is fully exposed on the cutting face of the cutting slug. The matrix material also incorporates diamond grit in at least that portion of the cutting slug adjacent to the cutting face, and preferably uniformally throughout the volume of the matrix material. By reason of this combination of elements, a cutting slug is provided which has a geometry similar to that now only obtained by unleached PCD product but is characterised by the physical temperature and wear properties of leached PCD product.

These and other embodiments of the invention can best be understood by considering the following figures wherein like elements are referenced by like numerals.

BRIEF DESCRIPTION OF THE DRAWINGS

FIG. 1 is a diagrammatic perpsective view of a first embodiment incorporating a triangular PCD element.

FIG. 2 is a diagrammatic perspective view of a second embodiment of the invention incorporating a traingular diamond element.

FIG. 3 is a diagrammatic perspective view of a third embodiment of the invention incorporating a triangular diamond element.

FIG. 4 is a perspective view of a fourth embodiment of the invention incorporating a triangular diamond element.

FIG. 5 is a perspective view of a fifth embodiment of the invention incorporating a triangular diamond element.

FIG. 6 is a plan view of a sixth embodiment of the invention incorporating a triangular diamond element.

FIG. 7 is a perspective view of a seventh embodiment of the invention incorporating a rectangular diamond element.

FIG. 8 is a diagrammatic perspective view of the eighth embodiment of the invention incorporating a higher order polyhedral shaped diamond element.

The invention and its various embodiments are better understood by considering the above Figures in light of the following detailed description.

DETAILED DESCRIPTION OF THE PREFERRED EMBODIMENTS

The invention is an enlarged diamond cutter in a rotating bit comprised of a plurality of synthetic polycrystalline diamond elements. The diamond elements are bonded or embedded in a cutting slug formed of matrix material. The matrix material further incorporates diamond grit so that the arrayed PCD elements, each of which have exposed surfaces on the cutting face of the cutting slug, together with the diamond impregnated matrix material therebetween simulates an integral enlarged diamond table. However, the composite diamond table made from these components in turn is characterised by the physical, temperature and wear characteristics of the smaller components which may be chosen from leached diamond product. Therefore, diamond cutters having the geometric size and design configuration of the traditionally larger unleached diamond compacts can be fabricated using a multiple component array of leached diamond elements according to the invention. The invention is better understood by first considering the embodiment in FIG. 1.

Turn now to FIG. 1 wherein a diamond cutter, generally denoted by reference numeral 10, is diagrammatically depicted in perspective view as forming the diamond table for an infiltrated integral matrix tooth, also generally denoted by reference numeral 12. Diamond cutter 10 is comprised of a plurality of synthetic PCD elements 14. In the illustrated embodiment, diamond elements 14 are triangular prismatic elements such as are sold by General Electric Company under the trademark 2102 GEOSET and 2103 GEOSET. This material is leached diamond material which exerts greater temperature stability and improved wear characteristics than unleached diamond material, such as sold by General Electric Company under the trademark STRATAPAX.

Diamond elements 14 are arranged and grouped in an array which collectively comprises diamond cutter 10. In the case of FIG. 1, wherein diamond elements 14 are equilateral triangular prismatic elements, four such elements can be arranged to collectively form a larger equilaterial triangular prismatic shape. For example, in the case where 2103 GEOSETs are used as diamond elements 14, four such elements can be combined to form an equilateral prismatic triangular shape having a side of 12 mm, and not 6 mm as in the case of a 2103 GEOSET. Clearly, the number of PCD elements 14 can be increased to construct even larger triangular arrays than that depicted in FIG. 1.

The triangular array formed by diamond cutter 10 contemplates a compact array of diamond elements 14 wherein each diamond element is in contact with, or in the immediate proximity of, at least one adjacent diamond element 14. In the illustrated embodiment, each diamond element 14 in the array is bonded to an adjacent diamond by a thin layer of matrix material generally constituted of tungsten carbide and such other elements and compounds as are well known in the art in powder metullurgy for inclusion in such metallic matrices. Matrix material layer 16 is shown in FIG. 1 simply as a dimensionless line. It is entirely within the scope of the invention that diamond elements 14 may also be arranged in a spaced-apart relationship with the interstitial spaces completely filled with matrix material 16. PCD elements in the invention in a compact array may actually touch each other or may be separated by a thin layer of matrix material which tends to bond the adjacent elements together. For the purposes of this specification, either situation or its equivalent shall be defined as an "immediately proximate" configuration.

Again, according to the invention, matrix material 16 as shown in FIG. 1, for example, includes diamond grit dispersed at least in that portion of matrix material 16 in the proximity of the cutting face of diamond cutter 10. The mesh or grit size of the natural or synthetic diamond incorporated then matrix material 16 may be of any magnitude or range according to the granularity and wear resistance properties ulitimately desired as dictated by well known principles. Generally, a grit diameter in the range of 0.01 inch (0.254 mm) to 0.05 inch (1.27 mm) suffices. Generally, a diamond grit concentration uniformly dispersed Through matrix material 16 of 50% to 100% by volume is utilized.

Turn now to FIG. 2, wherein the second embodiment is illustrated in perspective view. Again, a diamond cutter generally denoted by reference numeral 18 is shown as a part of an integral matrix tooth in a matrix body bit. Diamond cutter 18 is comprised of a plurality of triangular prismatic diamond elements 14 disposed within a cutting slug 20. Cutting slug 20 may have a variety of geometric shapes such as semicircular as shown in FIG. 2. Diamond elements 14 in the illustrated embodiment of Figure are set within cutting slug 20 in a spaced-apart relationship wherein matrix material 16 is disposed between adjacent diamond elements 14. Diamond elements 14 and matrix material 16 are identical to the like numbered elements described above in connection with the embodiment of FIG. 1.

The first and second embodiments of FIGS. 1 and 2 respectively are formed as part of a infiltrated matrix body bit, only the tooth of which is diagrammatically shown in the figures. Cutting slugs 10 and 20 can be formed by conventional hot press techniques or by infiltration techniques separately from the matrix body bit or may be formed simultaneously through infiltration techniques with the bit body. Consider first a fabrication technique using a hot press method. Triangular prefabricated synthetic diamonds 14 are placed within an appropriately shaped mold in the desired array. Thereafter, a mixture of metallic powder containing the dispersed diamond grit is tamped into the mold and distributed between diamond elements 14. Typically, a substantially greater thickness of diamond bearing metallic powder is placed in the mold than the thickness of PCDs 14. This differential thickness is to compensate for the greater compressibility of the powder as compared to the relatively noncompressible diamonds 14. Thereafter, the mold is closed by one or more anvils, typically made with the same material as the mold, such as carbon. The filled mold and anvils are then placed within a conventional hot press which typically heats the mold and its contents by an induction heater. Pressure and temperature is then applied to the filled mold, causing the diamond impregnated metallic powder to amalgamate and sinter, ultimately compressing to the shape of cutting slug 10 or 20, as defined by the mold. For example, a pressure of 200 psi and a temperature of 1900° F. held for 3 minutes is generally suitable for producing the desired cutting slug. The pressures and temperatures employed are well outside the diamond synthesis or diamond-to-graphite conversion phase regions so that substantially no diamond is created or destroyed in the process.

An infiltration technique may also be employed to either separately manufacture cutting slugs 10 and 20 or to manufacture cutting slugs 10 and 20 integrally with the matrix tooth. In the case where the cutting slugs are separately manufactured, an appropriately shaped carbon mold is fabricated and diamonds 14 set therein in the desired array. Once again, diamond impregnated metallic matrix powder is filled within the mold and mold then furnaced. The powder is allowed to sinter and infiltrate between diamonds 14 to form the finished cutting slug. Thereafter, the performed cutting slug may then be placed within a carbon mold for a matrix bit and fabricated into the bit in a conventional manner. Alternatively, diamond elements 14 may be individually glued into a mold for a matrix body bit in the desired array and position. Thereafter, the matrix body bit is filled first with a layer of diamond impregnated metallic powder and then is continued to be filled with various grades of metallic powder according to conventional matrix bit fabrication techniques. The entire mold is then furnaced so that the cutting slug is simultaneously and integrally formed with the body of the matrix bit.

Turn now to FIG. 3 wherein a third embodiment is illustrated showing a cutting slug, generally denoted by reference numeral 22, bonded to a steel or tungsten carbide stud 24 also well known to the art. Again, cutting slug 22 is comprised of an array of a plurality of prefabricated, synthetic PCDs 14*a* and 14*b*. Again, these diamonds are generally triangular prismatic elements such as 2103 and 2102 GEOSETS and are disposed in a diamond impregnated metallic matrix 16. The array of diamonds shown in the embodiment of FIG. 3 is comprised of a first grouping of diamonds 14*a* and a second grouping 14*b*. First grouping 14*a* are a plurality of diamonds in spaced apart relationship to form staggered rows of exposed triangular faces in an alternating inverted pattern. Group 14*b* of diamonds are placed along the circumference of circular cutting slug 22 so that their apical points 26 are directed in a generally radially outward direction. As cutting slug 22 wears, the apical points will begin to be exposed and provide for an aggressive cutting action along the edge of cutting slug 22. Diamonds in grouping 14*a* simulate a planar diamond table adapted for cutting soft rock. The two groupings 14*a* and 14*b* of diamonds in the embodiment of FIG. 3 are only shown hypothetically to illustrate that different arrays which can be employed, and to demonstrate that diamond groupings on a single cutting slug 22 may be varied at different regions within the cutting slug in order to provide edges or faces characterised by a different diamond profile and cutting behavior.

Cutting slug 22 is bonded by soldering, brazing and other means as diagrammatically indicated by braze layer 28, shown in greatly exaggerated view in FIG. 3. Stud 24 is then press fit, soldered or otherwise fitted into a bit body, typically a steel bit body as is well known to the art. Many such studs are known and could be advantageously combined with the cutting slugs of the present invention.

Turn now to FIG. 4 wherein a fourth embodiment of the invention is illustrated, again shown as a cutting tooth of a matrix bit body. Here the cutting slug, generally denoted by reference numerals 30, is rectangular or square in gross geometric outline and is comprised of an array of prefabricated PCDs 14 which are again generally triangular and prismatic in shape. Diamonds 14 are mounted within cutting slug 30 in a spaced apart relationship so that the interstitial spaces between diamonds 14 are again filled with diamond impregnated matrix material 16. Those diamonds 14 along the periphery of cutting slug 30 are oriented to have one side face 32 exposed and are coplanar with the flat sides of rectangular cutting slug 30. The end faces 34 of diamonds 14 are similarly exposed on the cutting face 36 of cutting slug 30. Although diagrammatically depicted as incorporated within a matrix tooth 38, a rectangular cutting slug 30 such as shown in FIG. 4 could be well adapted to a step bit where it could be bonded, soldered or brazed to the corners of the rectangular steps of the bit.

Turn now to FIG. 5 wherein yet a fifth embodiment of the invention is diagrammatically illustrated in perspective view. In the fifth embodiment a cutting slug, generally denoted by reference numeral 40, is comprised of a plurality of compactly arrayed diamonds 14. More particularly, diamonds 14 are bonded together in groups of six to form a regular hexagonal slug 40. Individual diamond elements 14 are bonded together by a thin matrix layer 16 between each adjacent diamond element 14. As with the prior embodiments, cutting slug 40 is fabricated by a conventional hot press or infiltration technique. The completed cutting slug 40 is similarly bonded to a stud 42 by soldering, brazing or other means as diagrammatically depicted by brazing layer 44.

The equilateral triangular prismatic diamond elements 14 of the embodiment of FIG. 5 can be generalized to form larger structures as shown in plan view in FIG. 6. Thus, a number of hexagonal arrays, each generally denoted by reference numeral 48, can be combined to form a larger cutting slug 46. Each hexagonal subarray 48 which forms part of larger array 46 is bonded together by diamond impregnated matrix material 16 as previously described.

Turn now to FIG. 7. Heretofore, the cutting slugs in each embodiment have been described as being built up of triangular prismatic prefabricated synthetic PCDs. The embodiment of FIG. 7 generalizes the teachings of the prior embodiments by incorporating prefabricated rectangular prismatic PCD or cubic diamond elements 50. Cubic diamond elements 50 are then combined and bonded together by thin layers of diamond impregnated metallic matrix 16 as before to form a larger cutting slug, generally denoted by reference numeral 52. In addition to forming the thin interstitial layer, bonding adjacent diamond elements 50, matrix material 16 may also frame or provide an outer encapsulating rectangular enclosure for the array of diamonds 50 for additional security. The rectangular or square cutting slug 52 of the embodiment of FIG. 7 can then be bonded to a stud cutter or integrally formed within a matrix body bit.

Turn finally to the embodiment of FIG. 8 wherein a higher order, regular polyhedral shaped diamond element 54 is combined with other like-shaped diamond elements of the same or different orders of polyhedral shapes in a compact or spaced-apart array to form an enlarged cutting slug, generally denoted by reference numeral 56. In the embodiment of FIG. 8, pentagonal element 54 are employed in an array wherein some of the elements 54 may contact each other while others remain in spaced-apart relationship. Again, elements 54 are bound to each other and in cutting slug 56 by amalgamation in a diamond impregnated matrix material 16 formed by hot pressing or infiltration.

Many other modifications or alterations may be made by those having ordinary skill in the art without departing from the spirit and scope of the invention. The illustrated embodiment has only been shown by way of an example and should not be taken as limiting the invention which is defined in the following claims.

We claim:

1. A diamond cutter in a rotating drag bit comprising:

a plurality of leached, prefabricated polycrystalline diamond (PCD) synthetic elements each having at least one end surface; and a cutting slug formed of matrix material, said plurality of PCD elements disposed within said cutting slug and said matrix material filling between said plurality of PCD elements, said cutting slug characterized by a cutting face, said one end surface of said PCD elements fully exposed on said cutting face, said matrix material forming said cutting slug further comprising diamond grit incorporated at least in that portion of said cutting slug in the proximity of said cutting face, said one end surface of said plurality of PCD elements collectively comprising said cutting face of said cutting slug, said cutting face thus being predominantly characterized by exposed diamond, whereby an enlarged diamond cutter is provided for mounting in said drag bit, and whereby said diamond cutter simulates an integral diamond table.

2. The cutter of claim 1 wherein said diamond grit impregnated in said matrix material is uniformly dispersed throughout said volume of matrix material.

3. The cutter of claim 2 wherein said plurality of said PCD elements are disposed in said cutting slug in a compact array wherein each PCD element is immediately proximate to at least one adjacent PCD element.

4. The cutter of claim 2 wherein said plurality of PCD elements are disposed in said array in said cutting slug in a spaced-apart relationship wherein said matrix material is disposed between said adjacent PCD element and no PCD element is immediately proximate to any adjacent element.

5. The cutter of claim 1 wherein said plurality of PCD elements are arranged and configured in said cutting slug in a plurality of distinguishable arrays.

* * * * *